United States Patent [19]

Caillon et al.

[11] Patent Number: 4,905,922

[45] Date of Patent: Mar. 6, 1990

[54] DEVICE FOR ROTATING A ROLLING-UP/UNROLLING SUPPORT, ESPECIALLY FOR A ROLLING-UP/UNROLLING TUBE FOR A NAUTICAL SAIL

[76] Inventors: Marc Caillon, 70 bis rue Jean Godefroy, 17000 La Rochelle; Jean Lartigue, 11 rue Cuvier, 31000 Toulouse, both of France

[21] Appl. No.: 185,746

[22] Filed: Apr. 25, 1988

[51] Int. Cl.[4] ..... B65H 75/00

[52] U.S. Cl. ..... 242/54 R; 254/339; 114/106; 74/625; 192/48.9

[58] Field of Search ..... 114/106, 105, 107; 254/364, 361, 339, 340; 242/54 R; 192/85 A, 67 R, 156 F, 48.9, 87.17; 74/625

[56] References Cited

U.S. PATENT DOCUMENTS

| | | | |
|---|---|---|---|
| 2,708,993 | 5/1955 | Munschauer | 192/56 F X |
| 2,963,134 | 12/1960 | Banner | 192/85 A X |
| 3,132,620 | 5/1964 | Court | 114/106 X |
| 3,931,958 | 1/1976 | Hobbs | 254/364 X |
| 4,269,134 | 5/1981 | Shapland | 114/107 |
| 4,275,870 | 6/1981 | Henneman et al. | 254/361 |
| 4,324,192 | 4/1982 | Ingouf | 114/106 |
| 4,489,919 | 12/1984 | Ostrobrod | 254/364 X |
| 4,503,797 | 3/1985 | Maurin | 114/106 |

FOREIGN PATENT DOCUMENTS

| | | | |
|---|---|---|---|
| 1154748 | 10/1983 | Canada | 254/339 |
| 8600629 | 4/1986 | Fed. Rep. of Germany . | |
| 985485 | 7/1951 | France . | |
| 8300665 | 11/1983 | Netherlands . | |
| 726381 | 4/1980 | U.S.S.R. | 74/625 |

*Primary Examiner*—John M. Jillions
*Assistant Examiner*—John M. Eghtessad
*Attorney, Agent, or Firm*—Harold H. Dutton, Jr.

[57] ABSTRACT

The invention relates to an apparatus for rotatably driving a winding-up/unwinding support, particularly a winding-up/unwinding tube for a sail. This apparatus comprises a transmission shaft (7) having an upper extremity provided with means for fixation (8) to a support, a manual control member (9, 10, 11) able to be actuated manually, a hydraulic motor (13) comprising a motor shaft (15) having one upper extremity of a form able to lodge the lower extremity of the transmission shaft (7), a clutch apparatus controlled by means of a fluid under pressure and having a clutch member (27) movable along the transmission shaft (7) and adapted to solidly connect said transmission shaft and the motor shaft (15) when the clutch apparatus is subjected to the pressure of the fluid, and the transmission shaft (7) and the manual control member (9, 10, 11) in the absence of fluid, and feed means adapted to simultaneously deliver a fluid to the hydraulic motor (13) and the clutch apparatus.

6 Claims, 6 Drawing Sheets

DEVICE FOR ROTATING A ROLLING-UP/UNROLLING SUPPORT, ESPECIALLY FOR A ROLLING-UP/UNROLLING TUBE FOR A NAUTICAL SAIL

The invention relates to a device for rotating a rolling-up/unrolling support, especially a tube for rolling up or unrolling a nautical sail, of the type comprising two independent modes of operation, manual and mechanical.

BACKGROUND AND OBJECTS OF THE INVENTION

Known devices for rolling up or unrolling typically comprise a winding up tube around which a sail is rolled, and means for causing the rotation in two directions of this winding up tube, comprising two actuating modes, either manual or mechanical. These devices such as described in German Pat. No. 8.600.629, French Pat. No. 985,485 and Netherlands Pat. No. 8.300.665, thus permit, in the mechanical mode of operation, centralizing and remotely controlling the different operations, while still permitting a manual operation in the event of complete failure of the mechanical system. However, these devices present several inherent disadvantages, notably, in this dual mode of operation. In the first place, the actuating systems, manual and mechanical, are not completely independent from each other, and the transition from one mode of operation to the other requires an intervention for engaging or disengaging the motor and separating the functions. Further, the devices described in German Pat. No. 8.600.629 and French Pat. No. 985.485 include a motor shaft extending perpendicularly with respect to the axis of the rolling up tube. For this reason, the reduction gearing between the number of turns of the motor and that of the rolling up tube is significant, and the manipulations to be carried out, in the manual actuation mode, are therefor long and tiresome. Finally, at the time that these devices are used for unrolling a supported sail, they are resisted by the forces transmitted by the support and therefor must be designed and constructed in such a manner as to resist any such forces.

The present invention seeks to overcome the deficiencies of the prior art devices and has as its primary object to provide an apparatus for driving a rolling-up/unrolling support comprising two independent actuating systems, manual and mechanical, and permitting an automatic change, without any intervention, from one mode of operation to the other.

Another object of the invention is to provide an apparatus in which the speed of rotation of the rolling-up tube is not multiplied with respect to that of the driving device by gearing.

Another object is to provide an apparatus capable of being used for unrolling a sail without being resisted by forces transmitted by the support cordage.

Another object is to provide an apparatus capable of being housed completely on the inside of a hollow mast, without having any projection to the exterior of this mast.

In order to facilitate understanding, the apparatus in accordance with the invention is described with the understanding that it is in place in a vertical mast, the terms "top," "bottom," "upper," "lower" referring to this position.

DESCRIPTION OF THE INVENTION

The device for rotatably driving a rolling-up/unrolling support according to the invention, comprises in combination:

- a transmission shaft comprising two extremities, termed upper and lower extremities, of which the upper one is provided with means for securing a winding-up/unwinding support,
- a manual control member arranged around the transmission shaft and able to be driven manually for causing rotation of said shaft,
- a hydraulic motor provided with a motor shaft extending in an extension or prolongation of the transmission shaft and comprising one, upper extremity of a form adapted to lodge the lower extremity of the transmission shaft,
- a coupling apparatus controlled by means of a fluid under pressure and interposed between the manual control member and the hydraulic motor, said coupling apparatus comprising a clutch member movable along the transmission shaft and adapted to, in the first case, solidly connect the transmission shaft and the motor shaft of the hydraulic motor when the coupling apparatus is subjected to the pressure of the fluid and, in the second case, to solidly connect the transmission shaft and the manual control member in the absence of fluid,
- means for feeding a fluid for simultaneously delivering said fluid to the hydraulic motor for driving the motor and to the coupling apparatus for controlling the same.

Thus, the apparatus according to the invention comprises a coupling apparatus adapted to be automatically positioned either in the mechanical actuation mode or in the manual actuation mode, the transition from one mode to the other being achieved simply by opening or closing of the feed circuit for the hydraulic motor and this coupling apparatus.

Such an apparatus thus offers a great flexibility in use since it may be actuated at any time, and without any particular intervention, either manual or mechanical, for example from a central control station. Moreover, it should be noted that any interruption in the feed of the fluid causes the shift of the apparatus into its manual mode, without the need for any further intervention, which thus permits immediately carrying out any necessary manipulations.

Due to the arrangement along the same axis of the rolling-up support, the transmission shaft and the motor shaft of the hydraulic motor, this apparatus does not involve any other reduction gearing between the speed of rotation of these different elements. The manipulations (or hand cranking) to be carried out, in case of manual actuation, are therefor notably reduced with respect to those needed by known devices.

According to a preferred embodiment:

the manual control member and the motor shaft of the hydraulic motor comprise respectively, opposite the coupling apparatus, a lower front face and an upper front face which are serrated, the coupling apparatus comprising:

- a housing defining a closed annular chamber around the transmission shaft, into which open the serrated front faces of the manual control member and the motor shaft,
- a shuttle piston provided with two serrated front faces, upper and lower, for coupling with the serrated front faces of the manual control member and the motor shaft, said shuttle piston being slidably mounted to be able to be freely displaced in the annular chamber around the transmission shaft, between an upper stop position where its upper front face is coupled with the opposite front face of the manual control member, and a lower stop position in which its lower front face is coupled with the opposite front face of the motor shaft, means for hydraulically displacing a shuttle piston towards its lower stop position comprising a fluid inlet through the housing and a sealed volume between the shuttle piston and the housing, for receiving said fluid, said shuttle piston being arranged to present a surface subjected to the pressure of fluid contained in the sealed volume in such a manner as to be subject to a downward force when said volume is under pressure, a return spring arranged in the annular chamber in such a manner as to urge the shuttle piston towards its upper stop position.

Such a structure permits achieving a linearly elongated driving device which, as will be better understood hereinafter, may be installed without difficulty on the inside of a hollow mast, without presenting any projections therefrom.

Further, the transmission shaft and the motor shaft used are preferably hollow shafts. Thus, during use of the device for rolling up a sail with stays or cordage supports, the sail may longitudinally traverse the device without any force acting on the drive device.

DESCRIPTION OF THE DRAWINGS

Other characteristics, objects and advantages of the invention will become apparent from the detailed description which follows with reference to the accompanying drawings which show by way of non-limiting examples, two preferred embodiments. In the drawings which form an integral part of the present description.

DESCRIPTION OF PREFERRED EMBODIMENTS

Figure 1:
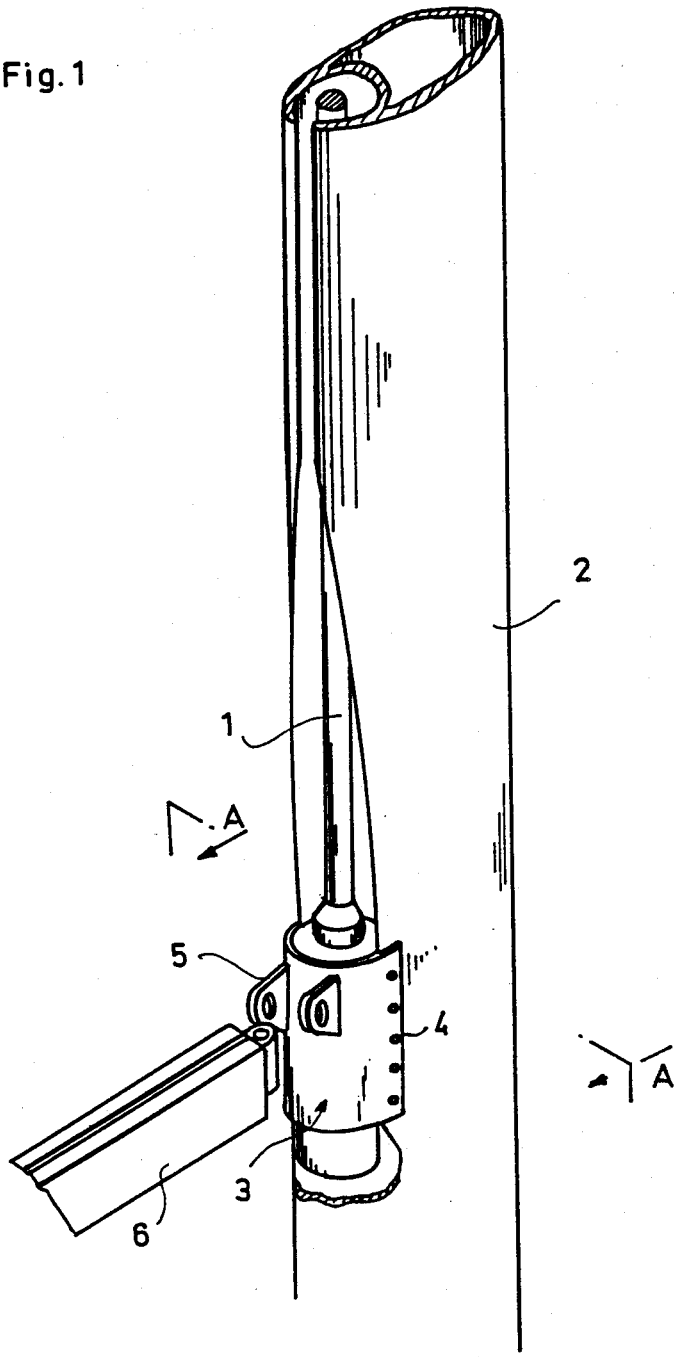
FIG. 1 is a schematic perspective view of a hollow mast equipped with an apparatus according to the invention.

The apparatus shown in the drawings is intended to drivingly rotate a tube 1 for rolling up or unrolling a sail arranged on the interior of a hollow mast 2. This apparatus, adapted to be inserted in the interior of the mast 2, is partially integrated on the interior of a casing 3 comprising two projections 4 provided with openings permitting the casing 3 to be secured to the mast 2 and two projections 5 for attachment of a boom 6.

This apparatus for causing the rotation comprises, firstly, a hollow transmission shaft 7 including in its lower half, and spaced a distance from its end, a fluted portion 7*a*. This shaft also comprises, at its upper end, a plate or flange 8 to be secured to the lower end of the rolling up or unrolling tube 1.

The rotation of this transmission shaft 7, and thus the rolling up or unrolling tube 1, may thus be caused by two different, independent actuating systems.

Figure 2:
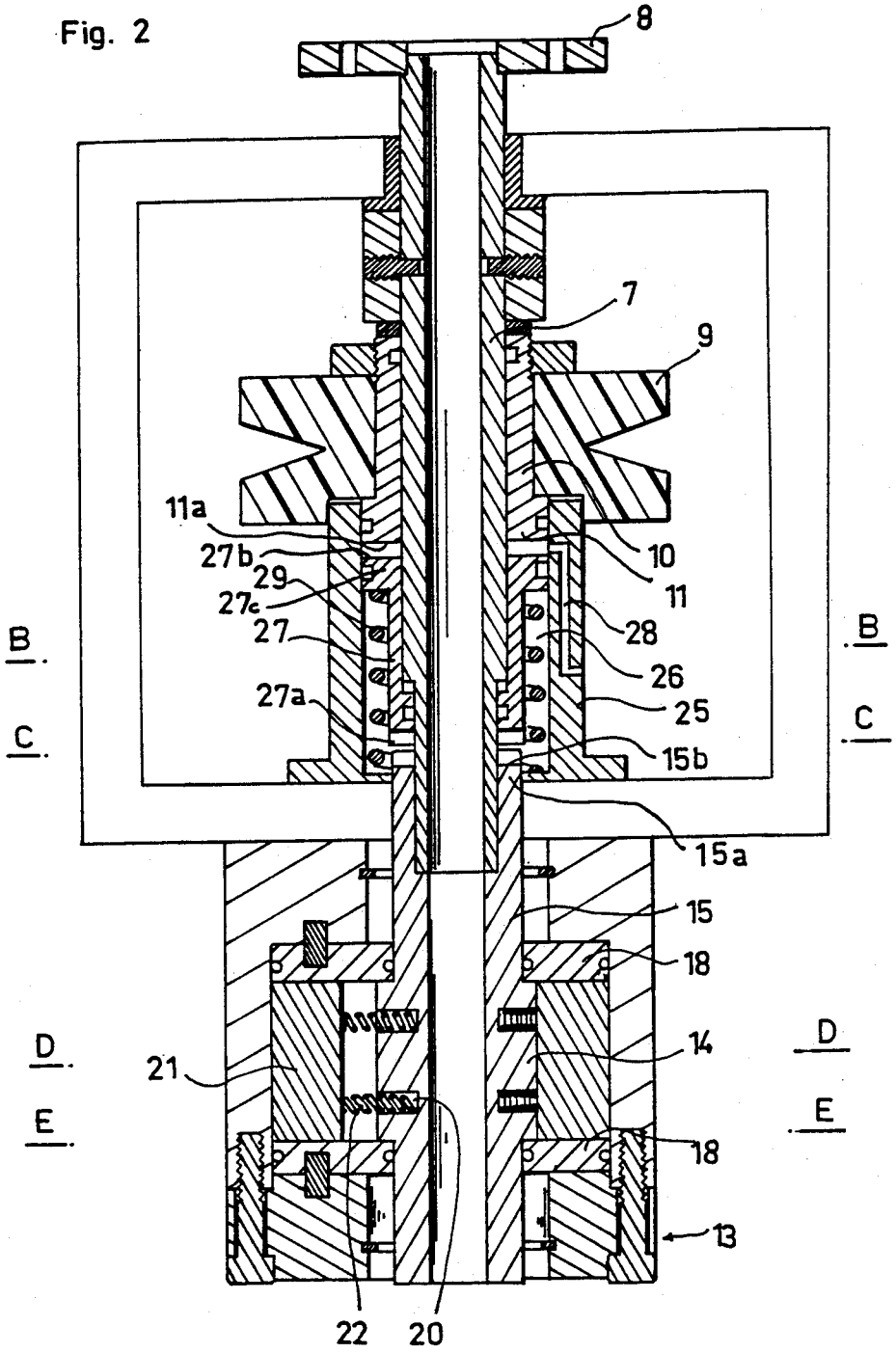
FIG. 2 is a longitudinal cross section along vertical plane AA, of a device according to the invention in its manual actuation mode.
Figure 3:
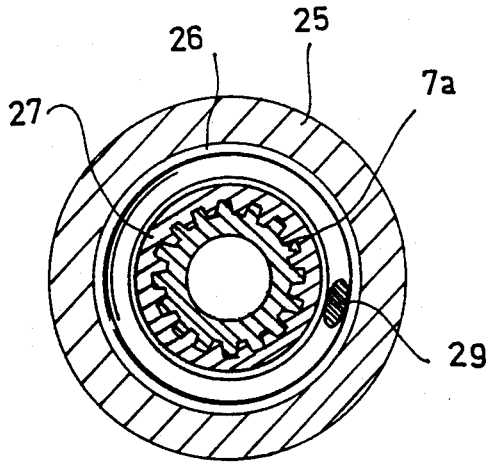
FIG. 3 is a transverse sectional view along a horizontal plane BB.
Figure 4:
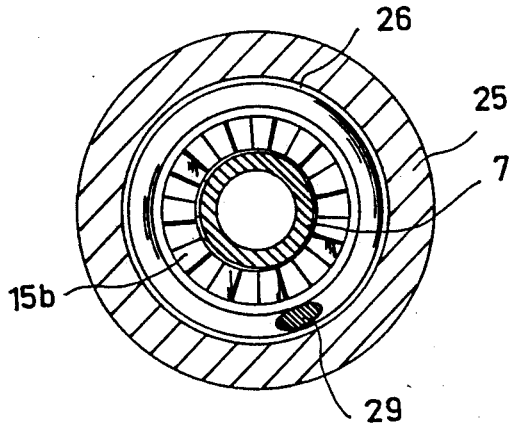
FIG. 4 is a transverse sectional view along a horizontal plane CC.
Figure 5:
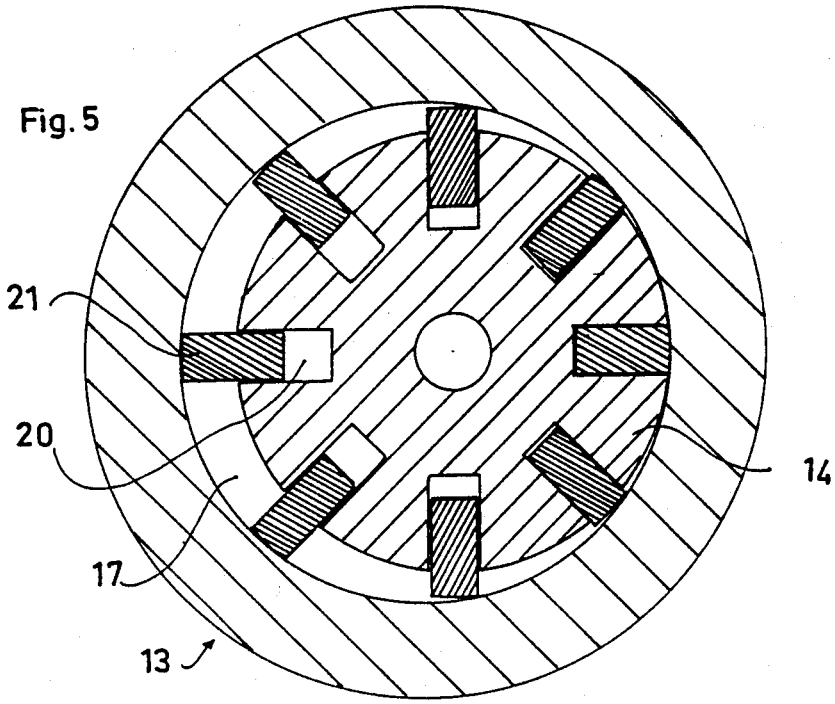
FIG. 5 is a transverse sectional view along a horizontal plane DD.
Figure 6:
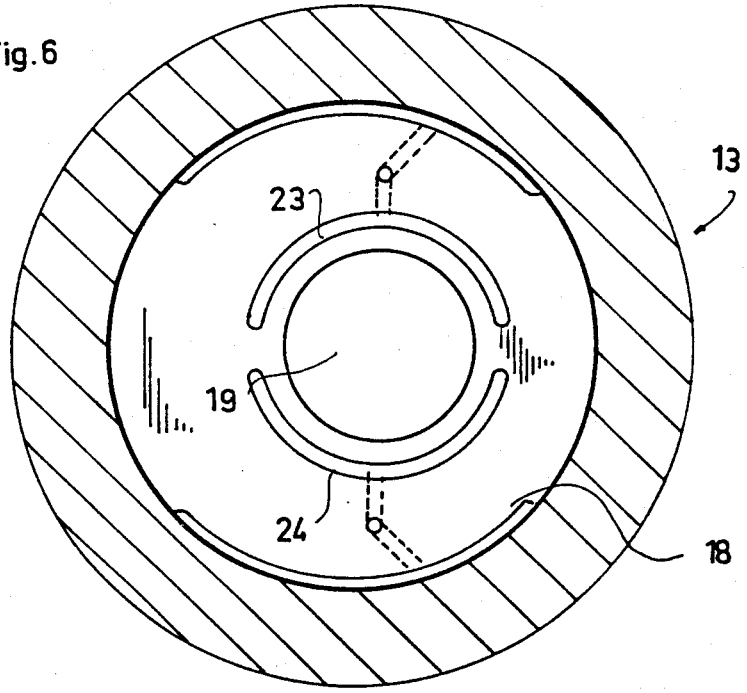
FIG. 6 is a transverse sectional view along a horizontal plane CC, the rotor of the hydraulic motor being removed.
Figure 7:
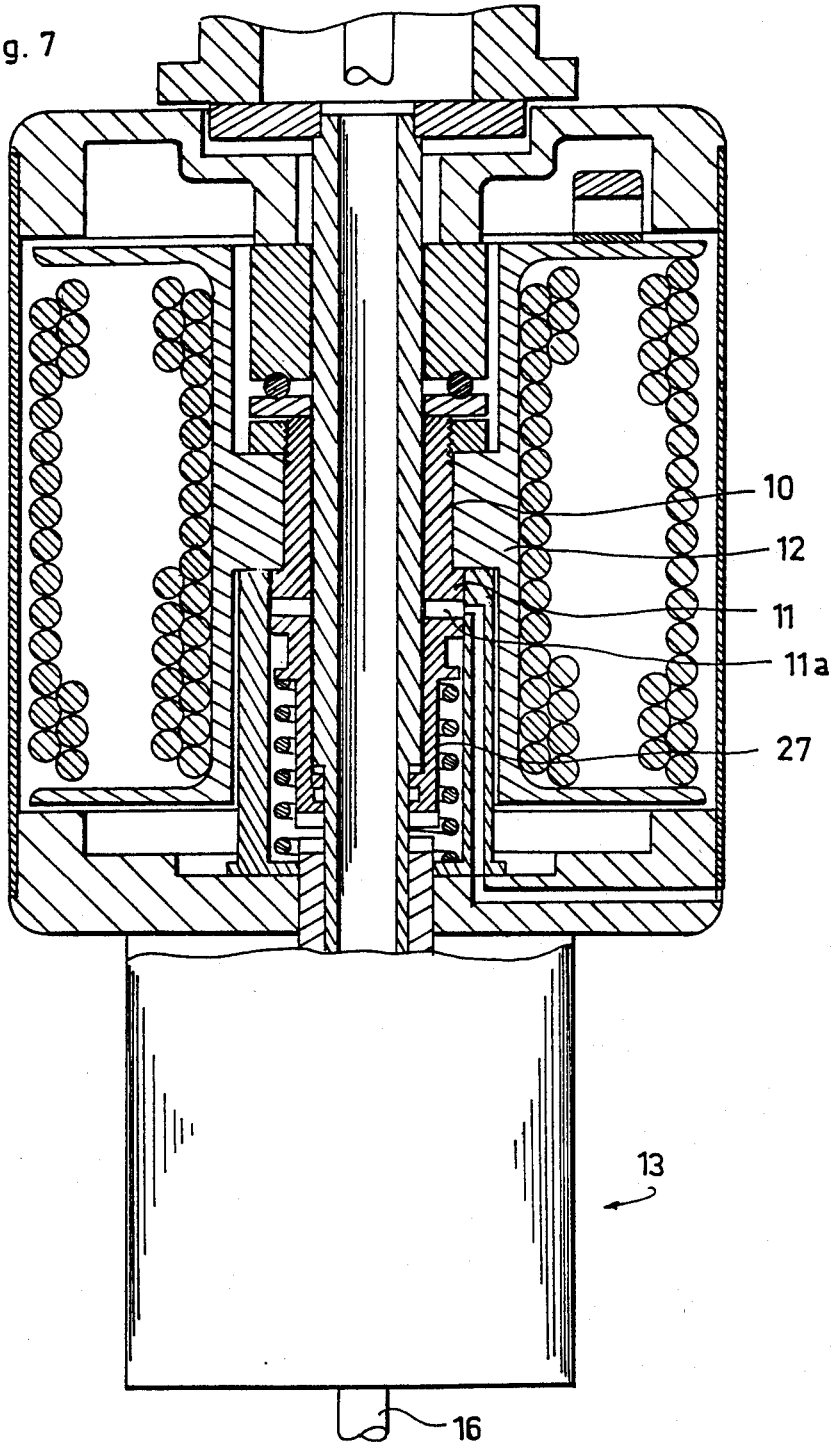
FIG. 7 is a partial longitudinal sectional view of a variation of a device according to the invention in its manual actuation mode.
Figure 8:
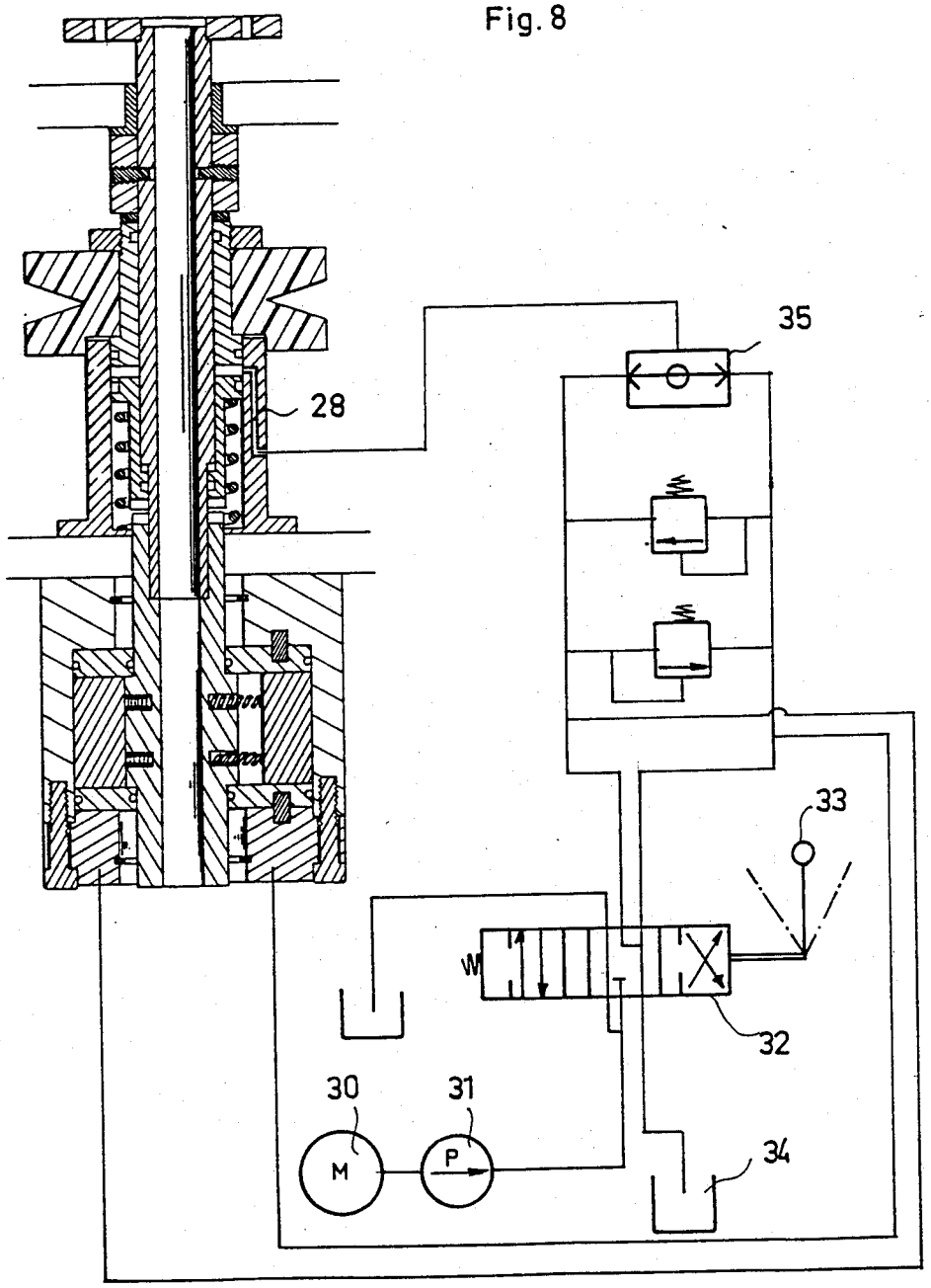
FIG. 8 is a schematic view illustrating the hydraulic feed circuit according to the invention.

The first actuating system, the manual type, may be of two different forms, shown respectively in FIGS. 2 and 7.

As seen in FIG. 2, the manual drive member comprises a pulley 9 driven by a cable or rope extending around a sleeve 10 which in turn is positioned around the transmission shaft 7, above the splined portion 7*a* thereof. This sleeve 10 has, at its lower extremity, a flange 11 provided with a serrated lower front face 11*a*.

According to FIG. 7, the manual drive member comprises a drum 12 itself mounted around a sleeve 10 comprising a flange 11, provided with a serrated lower front face 11*a*.

It should be noted that this manual drive member may also comprise a tangential wheel fastened, as before, around a sleeve and engaged by the intermediary of an endless screw actuated manually by means of a crank.

The second actuating system, of the mechanical type, comprises a hydraulic motor 13, of the paddle or plate type, arranged in the prolongation of the transmission shaft 7 and secured to the lower face of the casing 3. This hydraulic motor 13 comprises a cylindrical rotor 14 having a motor shaft 15 which includes an upper extremity 15*a* of a shape adapted to serve as a bushing for the lower end of the transmission shaft 7. This upper end of the motor shaft 15 also includes a serrated front face 15*b*.

The rotor 14 and the motor shaft 15 include a central longitudinal passageway. This passageway extends along the prolongation of the hollow transmission shaft permitting, in the case of a sail with a stay, the passage of this stay or support 16 across the apparatus, without any force coming to act upon the apparatus.

The rotor 14 and its motor shaft 15 are mounted in the interior of a housing defining a cylindrical groove for the motor shaft and a cylindrical chamber 17 of a diameter greater than that of the rotor in which the latter is positioned in an eccentric manner.

This cylindrical chamber 17 comprises to frontal walls 18 each provided with an opposite eccentric orifice 19 for the passage of the motor shaft 15.

In order to assure its rotation, the rotor 14 typically has in a conventional manner a plurality of longitudinal grooves 20 (in the example eight) arranged radially on its external peripheral face, on the interior of which are housed the vanes 21 maintained by means of springs 22 arranged in such a manner as to urge these vanes toward a position in which they project to the exterior of the grooves 20.

Finally, the cylindrical chamber 17 comprises two fluid passageways 23, 24 arranged in each of the frontal walls 18, on opposite sides of the axis of the rotor 14, and arranged in such a manner as to empty into the grooves provided directly above or below the grooves 20 of the rotor 14, toward the bottom thereof, and on the periphery of these frontal walls 18.

The shifting from one actuating mode to the other is assured by a hydraulic clutch apparatus interposed between the manual control member and the hydraulic motor 13.

This clutch apparatus comprises a housing 25 arranged around the splined portion *7a* of the transmission shaft 7 and defines around this portion a sealed annular chamber 26 into which open the serrated front faces 11*a*, 15*b* of the flange 11 of the sleeve 10 and of the motor shaft 15.

On the interior of this annular chamber 26 is arranged a shuttle piston 27 provided with two serrated front faces 11*a* and 15*b*. This shuttle piston 27 is slidingly mounted so as to be able to be displaced freely around the splined portion *7a* of the transmission shaft 7, between an upper stop position where its upper front face 27*b* is coupled with the grooved face 11*a* of the flange 11, and a lower stop position where its lower frontal face 27*a* is coupled with the grooved face 15*a* of the motor shaft 15.

The displacement of the shuttle piston 27 toward its lower stop position is controlled by hydraulic displacement means comprising an inlet 28 for fluid under pressure through the housing 25, and a sealed volume limited by the shuttle piston 27 and the front face 11*a* of the flange 11, said shuttle piston comprising an upper flange 27*c*, subjected to the pressure of fluid contained in the sealed volume in such a manner as to undergo a downward force when the volume is under pressure.

The return of the shuttle piston 27 toward its upper stop position, when the sealed volume is not under pressure, is achieved by means of a spring 29 arranged in the annular chamber 26 so as to urge the spring upwardly.

The driving apparatus further comprises means for feeding a fluid and adapted to simultaneously deliver said fluid to the hydraulic motor 13 so as to cause its rotation, and to the clutch for controlling the same.

This feed means comprises a thermal motor 30 and a feed pump 31 delivering the fluid toward a 4-way distribution valve 32 actuated by control handle 33, and adapted to present three states corresponding to three configurations of operation of the driving apparatus: rotation of the hydraulic motor 13 in one direction for rolling up the sail, rotation in the opposite direction for unrolling the sail, and stopping the hydraulic motor 13 with automatic transition to the manual actuation mode.

In the first two states, the fluid is delivered toward one of the fluid passages 23 or 24 of the hydraulic motor 13, the other of the passages 24 or 23 being connected to a sump 34; the hydraulic motor 13 is thus caused to rotate in one direction or the other.

Simultaneously, this fluid is delivered to the fluid inlet 28 of the clutch device through an "OR" valve 35, and the shuttle piston 27 is displaced toward its lower stop position in which it couples the motor shaft 15 and the transmission shaft 7.

In the third state of the distribution valve 32, the fluid is delivered to a sump 34. The hydraulic motor 13 is in a stop position, while the shuttle piston 27, no longer subjected to the pressure of this fluid, is displaced toward its upper stop position where it becomes coupled with the manual control member.

We claim:

1. An apparatus for rotatably driving a rolling-up or unrolling support (1) for a sail and including independent manual and mechanical actuating systems and comprising in combination:

a transmission shaft (7) having upper and lower extremities, said upper extremity including means (8) for attachment to the rolling-up or unrolling support (1), a manual drive member (9, 10, 11; 10, 11, 12) arranged around said transmission shaft (7) and able to be manually operated for rotating said transmission shaft, a hydraulic motor (13) having a motor shaft (15) extending coaxially with said transmission shaft (7) and having an upper extremity (15*a*) forming a bushing for the lower extremity of said transmission shaft (7), clutch means controlled by a fluid under pressure and interposed between said manual drive member (9, 10, 11; 10, 11, 12) and said hydraulic motor (13), said clutch means comprising a clutch member (27) movable along said transmission shaft (7) and adapted to drivingly connect (i) said transmission shaft and the motor shaft (15) of the hydraulic motor (13) when the clutch apparatus is subjected to the pressure of the fluid, and (ii) the transmission shaft (7) and the manual control member (9, 10, 11; 10, 11, 12) in the absence of fluid pressure, means for feeding a fluid (23, 24, 28, 30-35) for simultaneously delivering said fluid to said hydraulic motor (13) for operating said motor, and to said clutch means for controlling said clutch member.

2. An apparatus as in claim 1, and wherein said manual drive member (9, 10, 11; 10, 11, 12) and said motor shaft (15) include respectively, a lower frontal face (11*a*) and an upper frontal face (15*b*), each frontal face being serrated, said clutch apparatus comprising a housing (25) defining an annular piston chamber around the transmission shaft (7), said serrated frontal faces (11*a*, 15*b*) of the manual control member (9, 10, 11; 10, 11, 12) and the motor shaft (15) facing said piston chamber, a shuttle piston (27) having serrated upper (27*b*) and lower (27*a*) front faces couplable alternatively with said serrated front faces (11*a*, 15*b*) of said manual control member (9, 10, 11; 10, 11, 12) and with said motor shaft (15), said shuttle piston being slidingly mounted in said chamber so as to be freely displaceable in said annular chamber (26) around said transmission shaft (7) between an upper stop position wherein the upper front face (27*b*) of said piston is coupled with the serrated front face (11*a*) of the manual drive member (9, 10, 11; 10, 11, 12) and a lower stop position wherein the lower front face (27*a*) of said piston is coupled with the serrated front face (15*b*) of the motor shaft (15), means for hydraulically displacing the shuttle piston toward its lower stop position and comprising a fluid inlet (28) through said housing (25) and a sealed space between the shuttle piston (27) and the housing (25) for receiving said fluid, said shuttle piston having a surface (27*b*) subjected to the pressure of fluid contained in the sealed space so as to be subject to a downward force when said volume is under pressure, and a return spring (29) arranged in the annular chamber (26) so as to urge the shuttle piston toward the upper position in the absence of fluid pressure in said chamber.

3. An apparatus as in one of claim 2 and wherein said transmission shaft (7) and said motor shaft (15) are hollow shafts allowing for the passage of a cable such as a sail support (16).

4. An apparatus as in claim 2 and wherein said manual control member comprises a pulley (9) rotated by a cable system, said pulley being secured to a sleeve (10) arranged on the transmission shaft (7) and having a lower serrated wall (11*a*) defining the upper limit of said annular chamber (26) of the clutch apparatus.

5. An apparatus as in claim 2 and wherein said manual control member comprises a wind-up drum secured to a sleeve (10) arranged around said transmission shaft (7) and having a serrated lower front wall (11*a*) defining the top of said annular chamber (26) of the clutch apparatus.

6. An apparatus as in claim 2 and wherein said hydraulic motor (13) comprises a hydraulic motor having bi-directional reaction plates.

* * * * *